US009114509B2

(12) United States Patent
Lovely et al.

(10) Patent No.: US 9,114,509 B2
(45) Date of Patent: Aug. 25, 2015

(54) ROTARY RATCHETING WRENCH

(71) Applicant: Meridian International Co., Ltd., Songjiang, Shanghai (CN)

(72) Inventors: Dominic Lovely, Centennial, CO (US); Anthony Kriz, Centennial, CO (US); Brent Christopher, Centennial, CO (US)

(73) Assignee: Meridian International Co., Ltd. (CN)

( * ) Notice: Subject to any disclaimer, the term of this patent is extended or adjusted under 35 U.S.C. 154(b) by 375 days.

(21) Appl. No.: 13/767,382

(22) Filed: Feb. 14, 2013

(65) Prior Publication Data

US 2013/0205952 A1 Aug. 15, 2013

Related U.S. Application Data

(60) Provisional application No. 61/598,679, filed on Feb. 14, 2012.

(51) Int. Cl.

| | |
|---|---|
| ***B25B 13/46*** | (2006.01) |
| ***B25B 13/06*** | (2006.01) |
| ***B25B 13/56*** | (2006.01) |

(52) U.S. Cl.

CPC ..... *B25B 13/463* (2013.01); *B25B 13/06* (2013.01); *B25B 13/56* (2013.01)

(58) Field of Classification Search

CPC ..... B25B 13/463; B25B 13/56; B25B 13/06
See application file for complete search history.

(56) References Cited

U.S. PATENT DOCUMENTS

| | | | | |
|---|---|---|---|---|
| 65,550 | A | | 6/1867 | Dunlan |
| 103,656 | A | | 5/1870 | Mathias |
| 278,053 | A | | 5/1883 | Shipherd |
| 915,446 | A | | 3/1909 | Kearnes |
| 1,292,285 | A | * | 1/1919 | Fairchild ..... 81/60 |
| D53,597 | S | | 7/1919 | Marcmann |
| 1,320,137 | A | | 10/1919 | Gunn |
| 1,331,956 | A | | 2/1920 | Cross |
| D57,323 | S | | 3/1921 | Evans |
| 1,426,127 | A | | 8/1922 | Tuttle |
| 1,431,064 | A | | 10/1922 | Treisch |

(Continued)

FOREIGN PATENT DOCUMENTS

| | | |
|---|---|---|
| DE | 1136950 | 9/1962 |
| DE | 2231385 | 1/1974 |

(Continued)

OTHER PUBLICATIONS

Sears. Craftsman Dog Bone SAE Wrench, Webpage—Product Description.

(Continued)

*Primary Examiner* — David B Thomas
(74) *Attorney, Agent, or Firm* — Jason R. Sytsma; Shuttleworth & Ingersoll, PLC

(57) ABSTRACT

A ratcheting wrench includes a handle and a working end. A body is combined to the working end of the handle for rotation with respect to the working end around a first axis. A pawl couples the working end of the handle to the body for one-way rotation of the body around the first axis. A removable insert is coupled to the body for rotation with respect to the body around a second axis that is perpendicular to the first axis. A catch assembly selectively couples the insert to the body, so that the insert can be removed.

23 Claims, 5 Drawing Sheets

(56) References Cited

U.S. PATENT DOCUMENTS

| | | | | |
|---|---|---|---|---|
| 1,453,607 | A | 5/1923 | Saucier | |
| 1,519,800 | A | 12/1924 | Georges | |
| 1,571,148 | A | 1/1926 | Sisolak | |
| 1,601,767 | A | 10/1926 | Peterson | |
| 1,723,033 | A | 8/1929 | Hartley | |
| 1,796,083 | A | 3/1931 | Carlberg | |
| 1,811,137 | A | 6/1931 | Kress | |
| 2,028,561 | A | 1/1936 | Pilger | |
| 2,491,623 | A | 12/1949 | Sesak | |
| 2,500,835 | A | 3/1950 | Lang | |
| 2,628,522 | A | 2/1953 | Kraft | |
| 2,712,258 | A | 7/1955 | Keith | |
| 2,751,802 | A | 6/1956 | Reuillard | |
| 2,769,360 | A | 11/1956 | Cottrell | |
| 2,951,405 | A | 9/1960 | Engquist | |
| 2,977,824 | A * | 4/1961 | Rueb | 76/114 |
| 3,044,591 | A | 7/1962 | Kilness | |
| 3,342,229 | A | 9/1967 | Igor | |
| 3,475,999 | A | 11/1969 | Roberts et al. | |
| D224,677 | S | 8/1972 | Lehnhard | |
| 4,257,507 | A | 3/1981 | Solomon | |
| 4,515,044 | A | 5/1985 | Harstad | |
| 4,722,252 | A | 2/1988 | Fulcher et al. | |
| 4,748,875 | A | 6/1988 | Lang | |
| D299,206 | S | 1/1989 | Krapowicz | |
| 4,901,608 | A | 2/1990 | Shieh | |
| 4,916,987 | A | 4/1990 | Le Duc | |
| 5,119,701 | A | 6/1992 | Wei | |
| D332,730 | S | 1/1993 | Usuda | |
| 5,199,335 | A | 4/1993 | Arnold et al. | |
| 5,325,744 | A | 7/1994 | Horikawa | |
| 5,568,751 | A | 10/1996 | Lee | |
| 5,636,557 | A | 6/1997 | Ma | |
| 5,848,561 | A | 12/1998 | Hsieh | |
| 6,000,302 | A | 12/1999 | Chiang | |
| 6,050,165 | A | 4/2000 | Hall | |
| 6,101,902 | A | 8/2000 | Wei | |
| 6,125,725 | A | 10/2000 | Fox et al. | |
| 6,134,990 | A | 10/2000 | Ling et al. | |
| 6,263,768 | B1 | 7/2001 | Huang et al. | |
| 6,282,992 | B1 | 9/2001 | Hu | |
| 6,295,898 | B1 | 10/2001 | Hsieh | |
| 6,405,621 | B1 | 6/2002 | Krivec et al. | |
| 6,409,015 | B1 | 6/2002 | Hu | |
| 6,453,779 | B2 | 9/2002 | Hu | |
| 6,626,067 | B1 | 9/2003 | Iwinski et al. | |
| 6,629,477 | B2 | 10/2003 | Ling et al. | |
| 6,722,234 | B2 | 4/2004 | Hu | |
| D492,556 | S | 7/2004 | Barry et al. | |
| 6,769,330 | B2 | 8/2004 | Chang | |
| 6,782,777 | B1 | 8/2004 | Wei | |
| 6,820,742 | B1 | 11/2004 | Chen | |
| 6,862,956 | B1 | 3/2005 | Chen | |
| 6,868,759 | B2 | 3/2005 | Tuan-Mu | |
| 6,883,404 | B2 | 4/2005 | Hsien | |
| D506,373 | S | 6/2005 | Hsien | |
| 6,918,323 | B2 | 7/2005 | Arnold et al. | |
| 6,971,286 | B2 | 12/2005 | Hu | |
| 7,004,052 | B1 | 2/2006 | Shu-Sui et al. | |
| 7,032,478 | B2 | 4/2006 | Hu | |
| 7,066,055 | B1 | 6/2006 | Lee | |
| 7,082,860 | B2 | 8/2006 | Shu-Sui et al. | |
| 7,168,345 | B1 | 1/2007 | Hsieh | |
| 7,185,566 | B2 | 3/2007 | Arnold et al. | |
| 7,231,851 | B2 | 6/2007 | Tuan-Mu | |
| 7,237,460 | B2 | 7/2007 | Hu | |
| D551,525 | S | 9/2007 | Desbrunes | |
| 7,264,213 | B2 | 9/2007 | Liu | |
| 7,267,033 | B1 | 9/2007 | Lai | |
| 7,281,452 | B2 | 10/2007 | Chang | |
| 7,299,720 | B1 | 11/2007 | Schultz et al. | |
| 7,311,022 | B2 | 12/2007 | Putney et al. | |
| 7,318,366 | B2 | 1/2008 | Lee et al. | |
| 7,424,839 | B2 | 9/2008 | Chiang | |
| 7,444,902 | B1 | 11/2008 | Lin et al. | |
| 7,444,904 | B2 | 11/2008 | Huang | |
| 7,478,577 | B1 | 1/2009 | Wheeler | |
| 7,509,894 | B2 | 3/2009 | Chen | |
| 7,523,688 | B2 | 4/2009 | Putney et al. | |
| 7,565,973 | B2 | 7/2009 | Chang | |
| D601,871 | S | 10/2009 | Murray | |
| 7,827,886 | B2 | 11/2010 | Hu | |
| 7,966,912 | B1 | 6/2011 | Hobden et al. | |
| 8,141,460 | B2 | 3/2012 | Hobden et al. | |
| 8,312,794 | B2 | 11/2012 | Hobden et al. | |
| 8,387,489 | B2 * | 3/2013 | Hsu | 81/62 |
| 8,635,932 | B2 * | 1/2014 | Chen | 81/63 |
| 2003/0015070 | A1 | 1/2003 | Chen | |
| 2004/0040422 | A1 | 3/2004 | Chuang | |
| 2004/0093994 | A1 | 5/2004 | Hsiao | |
| 2004/0129114 | A1 | 7/2004 | Chen | |
| 2005/0166718 | A1 | 8/2005 | Chang | |
| 2005/0178247 | A1 | 8/2005 | Arnold et al. | |
| 2007/0044600 | A1 | 3/2007 | Chen | |
| 2007/0107560 | A1 | 5/2007 | Chiang | |
| 2007/0256525 | A1 | 11/2007 | Lee | |
| 2007/0277652 | A1 | 12/2007 | Tuan-Mu | |
| 2009/0301265 | A1 | 12/2009 | Hu | |
| 2009/0314139 | A1 | 12/2009 | Hu | |
| 2010/0050818 | A1 | 3/2010 | Rogers | |
| 2010/0326246 | A1 | 12/2010 | Chang | |
| 2011/0017024 | A1 | 1/2011 | Kriz | |
| 2011/0197714 | A1 | 8/2011 | Meholovitch | |
| 2011/0197718 | A1 | 8/2011 | Meholovitch | |
| 2012/0036967 | A1 * | 2/2012 | Hsu | 81/62 |
| 2012/0060653 | A1 * | 3/2012 | Hsu | 81/63.1 |
| 2012/0167722 | A1 * | 7/2012 | Chen | 81/60 |
| 2013/0081517 | A1 * | 4/2013 | Wen | 81/57.5 |

FOREIGN PATENT DOCUMENTS

| | | |
|---|---|---|
| DE | 202004000843 | 4/2004 |
| DE | 202006019735 | 3/2007 |
| EP | 0079440 | 5/1983 |
| FR | 630775 | 12/1927 |

OTHER PUBLICATIONS

Snap-On, Wrench, Ratcheting Box, 25° Offset, Product Webpage.

European Search Report dated Feb. 17, 2011 from related foreign application.

* cited by examiner

ROTARY RATCHETING WRENCH

This application claims priority to U.S. Provisional Application 61/598,679 filed Feb. 14, 2012, the entirety of which is incorporated by reference herein.

BACKGROUND

The instant invention relates generally to wrenches, and more specifically, to a ratcheting box wrench with replaceable inserts each containing multiple sockets.

Numerous wrenches have been provided in prior art that are hand held tools for gripping, turning or twisting objects such as nuts or bolts. While these units may be suitable for the particular purpose to which they address, they would not be as suitable for the purposes of the present invention as heretofore described.

SUMMARY

A ratcheting wrench is disclosed. The ratcheting wrench includes a handle and a working end. A body is combined to the working end of the handle for rotation with respect to the working end around a first axis. A pawl couples the working end of the handle to the body for one-way rotation of the body around the first axis. A removable insert is coupled to the body for rotation with respect to the body around a second axis that is perpendicular to the first axis. A catch assembly selectively couples the insert to the body, so that the insert can be removed.

DETAILED DESCRIPTION

Figure 1:
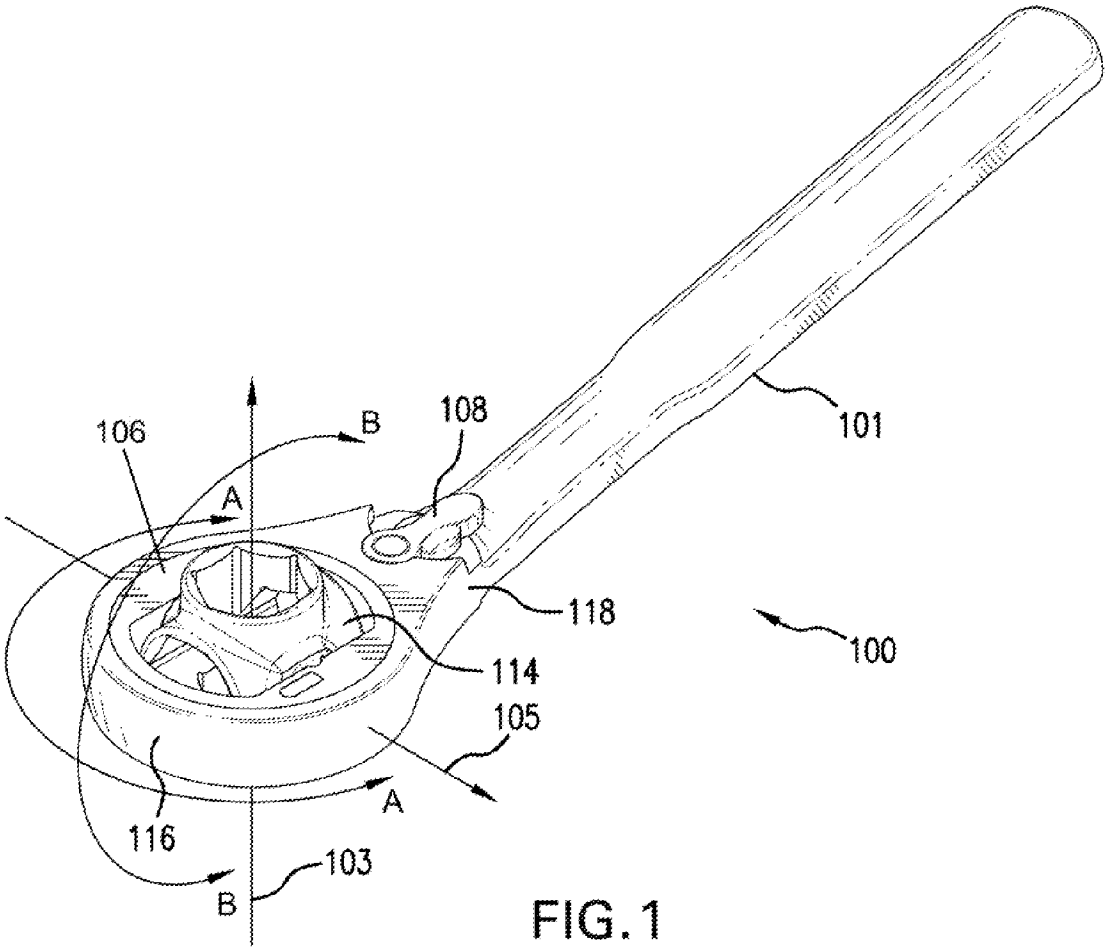
FIG. 1 is a perspective view of a ratchet wrench.
Figure 2:
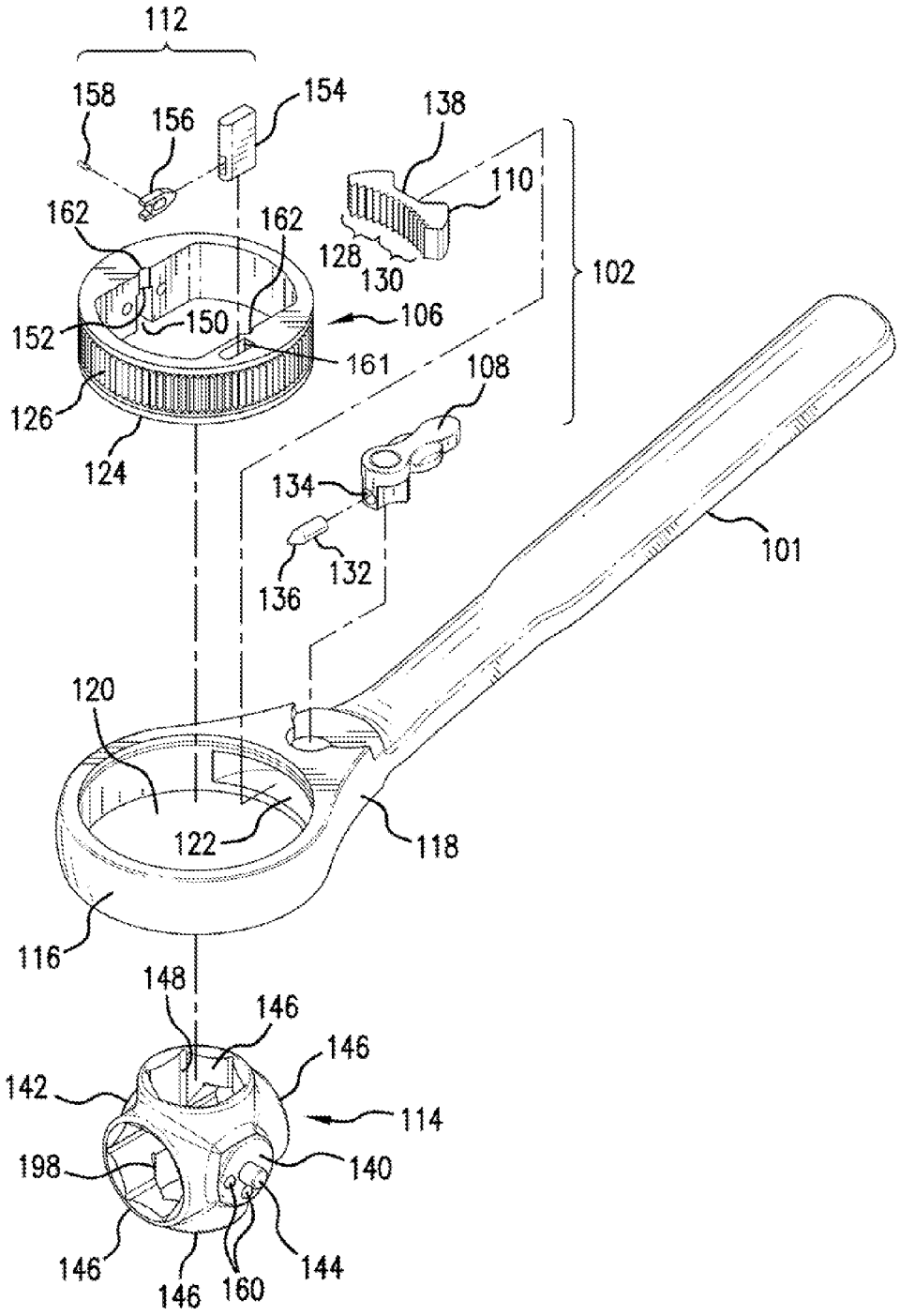
FIG. 2 is an exploded perspective view of the wrench of FIG. 1.

FIGS. 1 and 2 show an illustrated embodiment of a ratcheting wrench 100 constructed in accordance with the teaching of the present disclosure. Ratcheting wrench 100 has a handle 101 and one or two working ends 116. Although the drawings show only one working end 116, it is understood that a second working end 116 could be included at the other end of handle 101. Each working end 116 is connected to the handle by a neck 118 that orients handle 101 with respect to working end 116 generally in line, at a predetermined angle with respect thereto, or at selective positions with the inclusion of a pivoting mechanism.

Working end 116 generally has a ratcheting assembly 102 with a body 106, a selector switch 108, and a pawl 110, as shown in FIG. 2. Ratcheting assembly 102 combines working end 116 to body 106 for selective one-way rotation of body 106 with respect to working end 116 around a first axis 103 in the directions of the A arrows, as shown in FIG. 1.

A catch assembly 112 is combined to body 106 of ratcheting assembly 102, as shown in FIG. 2. Catch assembly 112 selectively combines a removable insert 114 to working end 116 for rotation of insert 114 around a second axis 105 that is perpendicular to first axis 103 in the directions of the B arrows, as shown in FIG. 1.

More specifically, with reference to FIG. 2, working end 116 of ratcheting wrench 100 defines a bore 120. Bore 120 is generally circular with a pawl pocket 122 that extends into neck 118. Body 106 has a generally annular outer surface 124 circumscribed by a plurality of teeth 126 that fits within bore 120 and pawl 110 fits within pawl pocket 122. In an alternative embodiment, working end 116 defines a bore 120 that is circumscribed with ratcheting teeth and pawl 110 is combined to body 106. In either the illustrated embodiment or one or more alternative embodiments, body 106 can be formed of appropriate material, such as steel, and can be unitarily formed as a casting then machine ground to the desired configuration.

Continuing with FIG. 2, pawl 110 can be a unitary structure comprising a first set of pawl teeth 128 and a second set of pawl teeth 130. Each first and second set of pawl teeth 128 and 130 can comprise one or more teeth. The first set of pawl teeth 128 can be mirrored about a center of pawl 110 such that the second set of pawl teeth 130 are mirror images of the first set of pawl teeth 128. Pawl 110, however, can be formed in any desired manner, including with first and second sets of pawl teeth 128 and 130 separated by a space.

Figure 5:
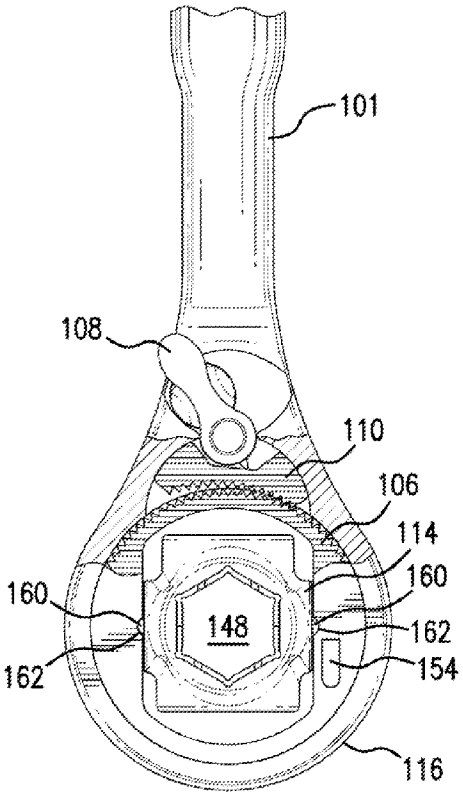
FIG. 5 is a top view of the wrench from FIG. 1 with a portion of an outer surface of the wrench removed to show a pawl engaged in a second position.
Figure 4:
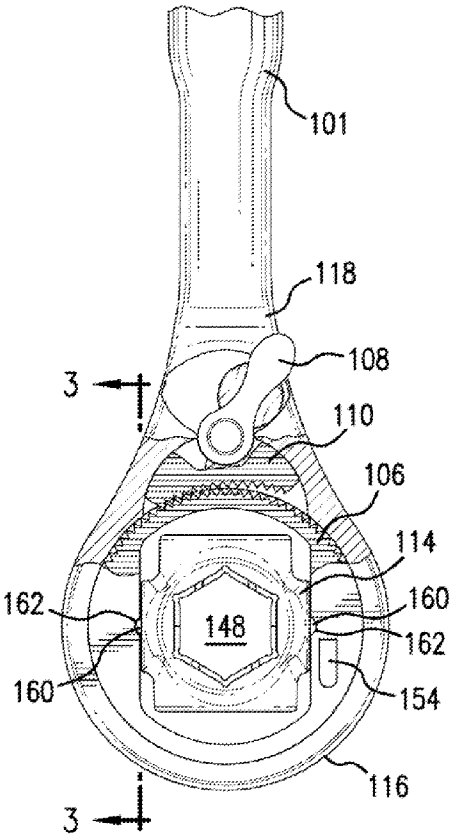
FIG. 4 is a top view of the wrench from FIG. 1 with a portion of an outer surface of the wrench removed to show a pawl engaged in a first position.
Figure 3:
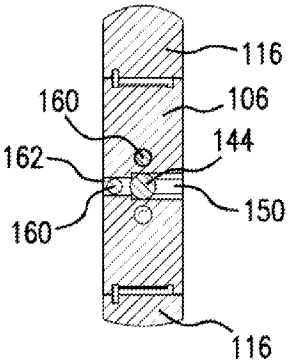
FIG. 3 is a cross-sectional view taken on the line 3-3 of FIG. 4 to illustrate the detents.
Figure 6:
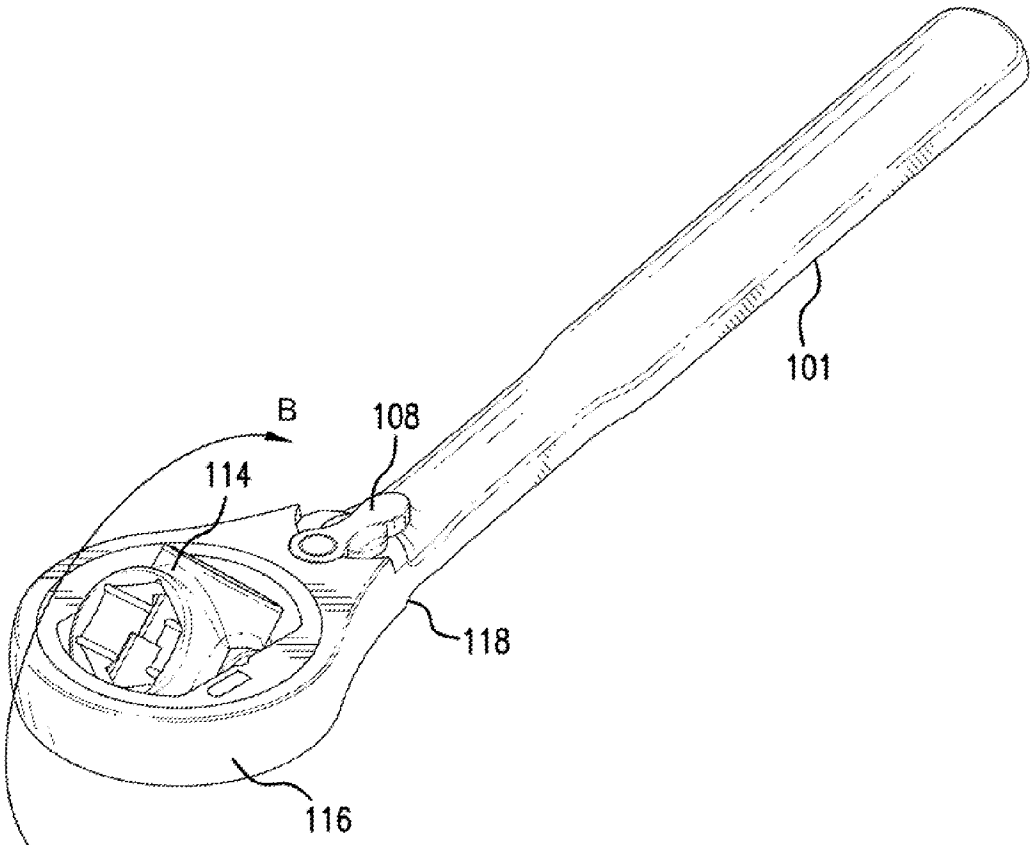
FIG. 6 is a perspective view of the ratchet wrench of FIG. 1 with an insert partially rotated.
Figure 7:
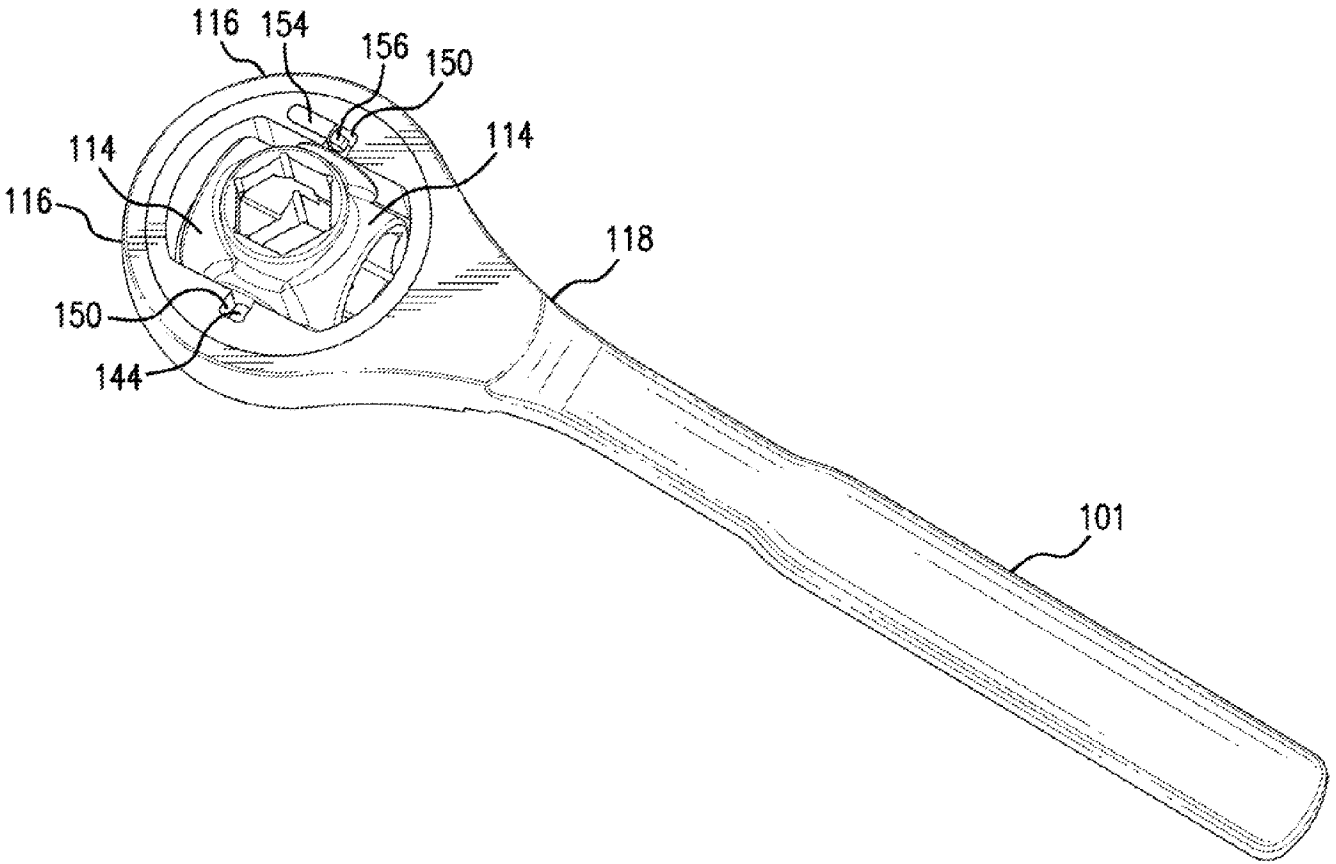
FIG. 7 is a bottom, perspective view of the ratchet wrench of FIG. 1.

As best seen in FIGS. 4 and 5, pawl 110 can be translated in pawl pocket 122 between a first position (FIG. 4), in which the first set of pawl teeth 128 engage the plurality of ratchet teeth 126 on body 106 to prevent rotation of body 106 relative to working end 116 in a first rotational direction, and a second position (FIG. 5), in which the second set of pawl teeth 130 engage the plurality of ratchet teeth 126 on body 106 to prevent rotation of body 106 relative to working end 116 in a second, opposite rotational direction. In an alternative embodiment, pawl 110 can be positioned in an intermediate position where both first and second set of pawl teeth engage ratchet teeth 126 to prevent rotation of body 106 relative to working end 116 in both first and second rotational direction.

Pawl 110 is moved between the first position and the second position by a switch 108 positioned on top of neck 118 of handle 101. Switch 108 is conveniently positioned for single-handed actuation. Switch 108 has a hole 134 to receive a protrusion 132 that engages and moves pawl 110 between the first and the second position. To accomplish this, protrusion 132 has a cone-shaped end 136 that slides against a back wall 138 of pawl 110 to smoothly transition pawl 110 between its respective positions.

With reference to FIG. 4, switch 108 is shown in a first position in which the cone-shaped protrusion 136 urges pawl teeth 128 against ratchet teeth 126 of body 106. Thus, when handle 101 is rotated in a clockwise direction, ratchet teeth 126 of body 106 apply a force to pawl teeth 128 to effectively lock ratchet teeth 126 and move insert 114 about second axis 103 in a clockwise direction. To change the ratcheting direction, switch 108 is moved to the second position shown in FIG. 5. Thus, when handle 101 is rotated in a counter-clockwise direction, ratchet teeth 126 of body 106 apply a force to second set of pawl teeth 130 that effectively locks teeth 130 to ratchet teeth 126 and move insert 114 about second axis 103 in a counter-clockwise direction.

Insert 114 defines a pair of rotary hubs 140 and 142, which defines the rotational, second axis 105 that extends between a pivot pin 144 positioned on each rotary hub 140 and 142. This second axis 105 extends perpendicular to axis 103. A plurality of tool members 146 are coupled to and extend radially from rotary hubs 140 and 142. Tool members 146 comprise a plurality of hollow cylindrical structures that are spaced circumferentially about rotary hubs 140 and 142, so that each tool member 146 is fixedly coupled to two adjacent tool members 146 and to rotary hubs 140 and 142. Each tool member 146 can define a desired tool or tool holder. In the illustrated embodiment, four tool members 146 are provided and each tool member has a differently sized hexagonal bore 148. It will be appreciated, however, that one or more of tool members 146 may be shaped differently from what is depicted. Insert 114 can also have one, two, three, four or more tool members 146.

If desired, each tool member 146 can be marked with an indicium to identify its size. The indicium can be raised relative to the surrounding surface of tool member 146 or recessed relative to the surrounding surface of tool member 146 or etched or painted thereon.

Each insert 114 can be selectively removed and received from a slotted interior in body 106. Pivot pins 144 are employed to rotatably couple rotary hubs 140 and 142 of inserts 114 to body 106. Each pivot pin 144 is received in a pivot pin slot 150 formed on the interior surface of body 106. As best seen in FIG. 2, each pivot pin slot 150 extends into body 106 terminating at a seat 152.

Catch assembly 112 is positioned in a slot 161 in body 106 to selectively combine insert 114 to body 106. Catch assembly 112 includes a catch body 154, a biased engaging member 156, and a pin 158 to combine biased engaging member 156 to catch body 154. Biased engaging member 156 extends into pivot pin slot 150 at a distance from seat 152 to selectively trap pivot pin 144 therebetween. In the illustrated embodiment, only one catch assembly 112 is disclosed, although a second catch assembly 112 could be included in the second pivot pin slot 150.

Insert 114 is removed and inserted from the bottom side of working end 116. Pivot pins 144 of insert 114 are positioned in line with pivot pin slots 150. When it is desired to remove insert 114, insert 114 is pushed downward so that one of pivot pins 144 engages biased engaging member 156 of catch assembly 112 and urges it inward back into the catch body 154 allowing the pivot pin 144 to pass. Conversely, when it is desired to insert 114, insert 114 is pushed upward so that one of pivot pins 144 will engage biased engaging member 156 to move it inwardly allowing the pivot pin to pass, after which the bias force moves biased engaging member 156 back into position in pivot pin slot 150, thereby trapping pivot pin 144 between biased engaging member 156 and seat 152. This allows insert 114 to rotate about second axis 105 without falling out of body 106. The bias force exerted on member 156 can be provided by a spring or any type of resilient material.

Insert 114 has its rotation about the second axis 105 provided by pivot pins 144 arrested by the interaction of detents 160 formed on rotary hubs 140 and 142 and depressions 162 formed in body 106 adjacent to seats 152. In one embodiment, each rotary hub 140 and 142 has a pair of detents 160 positioned at ninety degrees with respect to each other around pivot pin 144. FIG. 2 shows rotary hub 140 with a pair of detents 160, one in the six o'clock and one in the nine o'clock position, although not visible, rotary hub 142 has pair of detents 160, one in the twelve o'clock and one in the three o'clock position. In another embodiment, four detents 160 can be positioned at ninety-degree intervals around one or both rotary hub 140 and 142. As insert 114 is rotated, every ninety-degrees one of detents 160 will engage one of the two depressions 162. In this manner, insert 114 indexes in ninety-degree increments around the second axis of pins 144.

Handle 101 can be formed of an appropriate metal, such as steel, iron, titanium, or aluminum. In the illustrated embodiment, the handle is forged from steel as a unitary structure with neck 118 and working end 116. Subsequent machining operation can be employed to form the appropriate bores and other features.

Ratcheting wrench 100 can be provided at a point of sale in a package that includes multiple inserts 114. In this manner, a complete tool set with a variety of the standard and metric size tool members 146 can be provided. Tool members 146 can also include ¼" and ⅜" drive members to receive standard socket wrenches. A user can carry the whole set with him in a convenient carrying case and select and remove inserts 114 as desired. A single insert 114 can also be configured with four tool members 146 that have corresponding hexagonal bores 148 sized for a particular job so that the user can select and insert a single insert 114 for the particular job and leave the tool package behind.

Various aspects of any of the embodiments can be combined in different combinations than the ones shown to create new embodiments that fall within the scope of the appended claims.

While the present invention has been particularly shown and described with reference to exemplary embodiments thereof, it should be understood by those of ordinary skill in the art that various changes, substitutions and alterations can be made herein without departing from the scope of the invention as defined by appended claims and their equivalents. The invention can be better understood by reference to the following claims. For purpose of claim interpretation, the transitional phrases "including" and "having" are intended to be synonymous with the transitional phrase "comprising."

What is claimed is:

1. A ratcheting wrench, comprising:

a handle;

a working end combined to the handle and defining a hole;

a body received in the hole of the working end and being rotatable relative thereto around a first axis;

a pawl coupling the working end of the handle to the body;

an insert coupled to the body for rotation about a second axis that is perpendicular to the first axis; and a catch assembly selectively coupling the insert to the body so that the insert can be removed from the body wherein the catch assembly further comprises:

a catch body; and a biased engaging member cooperating with the catch body to selectively couple the insert to the body.

2. The ratcheting wrench of claim 1, wherein the body comprises a plurality of teeth circumscribing the body and the pawl is engageable with the teeth.

3. The ratcheting wrench of claim 2, wherein the pawl comprises a plurality of teeth that is engageable with the teeth circumscribing the body.

4. The ratcheting wrench of claim 3, wherein the pawl further comprises a first set of teeth and a second set of teeth, and the wrench further comprises a switch that interacts with the pawl to move the pawl between a first position in which the first set of teeth engage the teeth circumscribing the body to enable one-way clockwise rotation of the body around the first axis and a second position in which the second set of teeth engage the teeth circumscribing the body to enable one-way counter-clockwise rotation of the body around the first axis.

5. The ratcheting wrench of claim 1, wherein the body further comprises two pivot pin slots, each pivot pin slot extends from a bottom surface of the body into the body forming a seat at a bottom of the pivot pin slot.

6. The ratcheting wrench of claim 5, wherein the biased engaging member extends into the pivot pin slot to selectively combine the insert to the body.

7. The ratcheting wrench of claim 6, wherein the insert further comprises a pair of rotary hubs each having a pivot pin thereon so the insert can rotate about the pivot pin on the pair of rotary hubs, and a plurality of tool member coupled to and extend radially from the rotary hubs.

8. The ratcheting wrench of claim 7, wherein the insert has four drive members positioned therearound.

9. The ratcheting wrench of claim 7, the pivot pin on each of the rotary hubs of the insert are selectively positioned between the biased engaging member and the seat of the pivot pin slot on each side of the body for rotation about the second axis.

10. The ratcheting wrench of claim 1, wherein the working end has a top surface that is parallel to a bottom surface, and when the second axis is perpendicular to the top surface and the bottom surface, the handle projects angularly upward from the working end.

11. The ratcheting wrench of claim 1, wherein the insert further comprises a pair of rotary hubs and a pivot pin positioned on a center of each rotary hub defining the second axis, at least one of the rotary hubs has a plurality of detents positioned at a ninety-degree angles around the pivot pin, and wherein the body further comprises a depression that selectively receives one of the plurality of the detents to arrest rotation of the insert about the second axis.

12. The ratcheting wrench of claim 1, wherein the pawl is moveable into a first position and a second position corresponding with a clockwise rotation and a counterclockwise rotation of the body around the first axis.

13. The ratcheting wrench of claim 1, wherein the insert has a pair of detents, with each pair of detents positioned on a first side and a second side of the insert, wherein the pair of detents on each of the first side and the second side are positioned ninety degrees with respect to each other around the second axis, and wherein the pair of detents on the first side are positioned apart ninety degrees with respect to the pair of detents on the second side.

14. The ratcheting wrench of claim 13, and further comprising a first depression and a second depression positioned on opposite sides of the body and spaced apart from the second axis and adapted to receive the detent, wherein as the insert is rotated in ninety degree increments around the second axis one of the detents on either the first side or the second side is engaged in one of the first depression and the second depression to arrest rotation of the insert around the second axis.

15. A ratcheting wrench, comprising:

a handle;

a working end combined to the handle and defining a hole;

a body received in the hole of the working end and being rotatable relative thereto around a first axis;

a pawl coupling the working end of the handle to the body;

an insert coupled to the body for rotation about a second axis that is perpendicular to the first axis, wherein the insert has a pair of detents, with each pair of detents positioned on a first side and a second side of the insert, wherein the pair of detents on each of the first side and the second side are positioned ninety degrees with respect to each other around the second axis, and wherein the pair of detents on the first side are positioned apart ninety degrees with respect to the pair of detents on the second side; and a catch assembly selectively coupling the insert to the body so that the insert can be removed from the body, wherein the catch assembly further comprises:

a catch body; and a biased engaging member cooperating with the catch body to selectively couple the insert to the body.

16. A ratcheting wrench comprising:

a handle;

a working end combined to the handle;

a body received in the working end and being rotatable relative thereto about a first axis;

an insert selectively and pivotally coupled to the body for rotation about a second axis, the second axis being perpendicular to the first axis, the insert comprising a plurality of tool members that are spaced apart circumferentially apart from one another about the second axis;

a ratcheting assembly coupling the body and the working end, wherein the ratcheting assembly comprises a plurality of ratchet teeth and at least one pawl that is engageable with the ratchet teeth; and a catch assembly selectively coupling the insert to the body so that the insert can be removed from the body, wherein the catch assembly further comprises a catch body; and a biased engaging member cooperating with the catch body to selectively couple the insert to the body.

17. The ratcheting wrench of claim 16, wherein the insert further comprises a pair of rotary hubs each having a pivot pin thereon so the insert can rotate about the pivot pin on the pair of rotary hubs.

18. The ratcheting wrench of claim 17, wherein at least one of the rotary hubs has a plurality of detents positioned at a ninety-degree angles around the pivot pin, and wherein the body further comprises a depression that selectively receives one of the plurality of the detents to arrest rotation of the insert when one of the tool members is presented for use and coaxial with the first axis.

19. A ratcheting wrench comprising:

a handle;

a working end combined to the handle;

a body received in the working end and being rotatable relative thereto about a first axis;

an insert selectively and pivotally coupled to the body for rotation about a second axis, the second axis being perpendicular to the first axis, the insert comprising a plurality of tool members that are spaced apart circumferentially apart from one another about the second axis, wherein the insert further comprises a pair of rotary hubs each having a pivot pin thereon so the insert can rotate about the pivot pin on the pair of rotary hubs, wherein at least one of the rotary hubs has a plurality of detents positioned at a ninety-degree angles around the pivot pin, and wherein the body further comprises a depression that selectively receives one of the plurality of the detents to arrest rotation of the insert when one of the tool members is presented for use and coaxial with the first axis;

a ratcheting assembly coupling the body and the working end, wherein the ratcheting assembly comprises a plurality of ratchet teeth and at least one pawl that is engageable with the ratchet teeth; and a catch assembly selectively coupling the insert to the body so that the insert can be removed from the body, wherein the catch assembly further comprises:

a catch body; and a biased engaging member cooperating with the catch body to selectively couple the insert to the body.

20. The ratcheting wrench of claim 19, wherein the body further comprises two pivot pin slots, each pivot pin slot extends from a bottom surface of the body into the body forming a seat at a bottom of the pivot pin slot.

21. The ratcheting wrench of claim 20, wherein the biased engaging member extends into the pivot pin slot to selectively combine the insert to the body.

22. The ratcheting wrench of claim 21, wherein the pivot pins on the insert are received in the pivot pin slots of the body for rotation about the second axis.

23. The ratcheting wrench of claim 22, wherein the insert has four drive members positioned therearound.

* * * * *